US005466011A

United States Patent [19]

Cohn

[11] Patent Number: 5,466,011

[45] Date of Patent: Nov. 14, 1995

[54] CABLE IDENTIFICATION SYSTEM

[76] Inventor: David L. Cohn, 17801 Waxwing La., South Bend, Ind. 46635

[21] Appl. No.: 223,994

[22] Filed: Apr. 6, 1994

[51] Int. Cl.[6] ..... B43D 15/00

[52] U.S. Cl. ..... 283/67; 283/70

[58] Field of Search ..... 283/67, 70, 72, 283/74, 117, 44, 48.1; 101/18, 36, 37, 112

[56] References Cited

U.S. PATENT DOCUMENTS

| | | | |
|---|---|---|---|
| 1,369,450 | 2/1921 | Manss . | |
| 1,677,927 | 3/1927 | Pettee | 101/18 |
| 1,958,717 | 5/1934 | Schake et al. | 101/36 |
| 2,168,431 | 8/1939 | Olson | 101/36 |
| 2,186,555 | 1/1940 | Phillips | 101/36 |
| 2,211,792 | 8/1940 | Rohland | 101/36 |
| 2,211,793 | 8/1940 | Rohland | 101/36 |
| 2,227,694 | 1/1941 | Bates | 101/36 |
| 2,344,610 | 3/1944 | Hargreaves et al. | 101/36 |
| 2,351,224 | 6/1944 | Nystrom | 101/36 |
| 2,425,266 | 8/1947 | Robbins | 101/36 |
| 2,469,526 | 5/1949 | Sloat | 101/36 |
| 2,470,075 | 5/1949 | Robbins | 101/36 |
| 2,739,528 | 3/1956 | Lowe | 101/37 |
| 2,898,848 | 8/1959 | Gillies et al. | 101/36 |
| 2,898,849 | 5/1954 | Gillies | 101/37 |
| 3,225,688 | 12/1965 | Gillies | 101/36 |
| 3,709,143 | 1/1973 | Rundell | 101/37 |
| 3,788,213 | 1/1974 | Brown et al. | 101/37 |
| 4,056,343 | 11/1977 | Kaiser et al. | 101/74 |
| 4,163,570 | 8/1979 | Greenaway | 283/67 |
| 4,182,239 | 1/1980 | Timmins et al. | 101/11 |
| 4,997,994 | 3/1991 | Andrews et al. | 174/112 |
| 5,230,133 | 7/1993 | Esposito | 283/70 X |
| 5,343,648 | 9/1994 | Bracken | 283/70 X |
| 5,401,059 | 3/1995 | Fennario | 283/67 |

*Primary Examiner*—Willmon Fridie

[57] ABSTRACT

A new method and mechanism for associating information with a medium is provided. Unique markings are placed on the medium. The medium is defined by one or more segments, having first and second ends. The markings on each segment define a range of markings, which can be entered into a data base. By accessing a single marking, the information associated with that range of markings may be obtained.

8 Claims, 1 Drawing Sheet

CABLE IDENTIFICATION SYSTEM

BACKGROUND AND SUMMARY OF THE INVENTION

The present invention relates to a method and device by which a segment of cable, having a plurality of markings thereon, can be identified from other similar cable segments.

Computer interconnections may involve a vast array of electronic cables; it can be very difficult to keep track of each cable segment, its function and date of installation. Typically, cables that run between rooms in a building are hidden behind walls, in wireways and above ceilings for much of their length. Therefore, physical access to the cables can be difficult, and tracing the cables becomes a problem. As cataloging each cable segment is difficult, such records are rarely kept. Even if they were, identifying a single cable segment out of a set or class of dozens, or hundreds, is very difficult. As a result, cables are seldom reused or removed. Instead, new cable segments are run, and the old ones are left in place.

At times, it may be desirable to access a particular cable segment from a particular location, such as an office or work station. The location at which access is desired may not be adjacent to an end of the cable segment, and if there are several similar cables which service the office, it may be difficult to ascertain which is the desired cable segment.

When cable is installed in a building, it is often cut into segments on site, from a large spool. Several spools may be used on a single project, and there may be no continuity of application of the segments. That is, segments from several different spools may be used together, or segments from the same spool may be used in several places. Further, there is typically no preference for aligning segments in a particular direction; the cables are essentially non-directional.

Furthermore, each spool of cable may be substantially non-distinguishable from any other. They may be substantially of the same radius, color and composition. Thus, once several cable segments are installed in the building, it can be difficult to determine the purpose or function of any particular cable segment.

Therefore, it is an object of the present invention to provide a method and mechanism by which one may associate information with segments of cable.

Another object of the present invention is to be able to track and identify segments of cables or conduits.

These and other objects are attained in a method and mechanism for associating information with segments of cable or any other effectively infinite medium. One method includes marking cable with a plurality of unique, distinct markings. Each marking is unique from all other markings on any substantially nondistinguishable cable. The cable can then be divided into segments having definite ends. The marking closest to one end of the segment may be defined as the first marking, and the marking closest to the other end may be defined as the second marking. The first marking, second marking and all markings falling therebetween define a range of markings, associated with the segment. Short segments may have only a single marking.

The range of markings on a given cable segment can be recorded in a data base, together with the information associated with that segment. That information may include data concerning the medium or cable, or the information, energy or commodity being transported therein.

Later, when it is desired to obtain particular information concerning the segment, the segment may be accessed anywhere along its length. A single marking from within the range is located, and is read or entered into the data base. The corresponding entry in the data base provides the associated information.

In certain embodiments, the markings may be sequential; however, they need not be. When the markings are not sequential, they may be defined in some other manner.

Other objects, advantages and novel features of the present inventions will become apparent from the following detailed description of the inventions when considered in conjunction with the accompanying drawings.

DETAILED DESCRIPTION OF THE PREFERRED EMBODIMENTS

The present invention is directed to a method and mechanism by which one may associate information with segments of a medium. The medium of the present invention is shown for illustrative purposes as cable or conduit. Reference to this embodiment is for illustrative purposes only, and is not to be a taken as a limitation of the present invention. The medium of the present invention may also include wires, pipes, tapes, or other bodies used to transport energy, information, or other things. The scope of the present invention is contained solely within the claims which follow.

Figure 1:
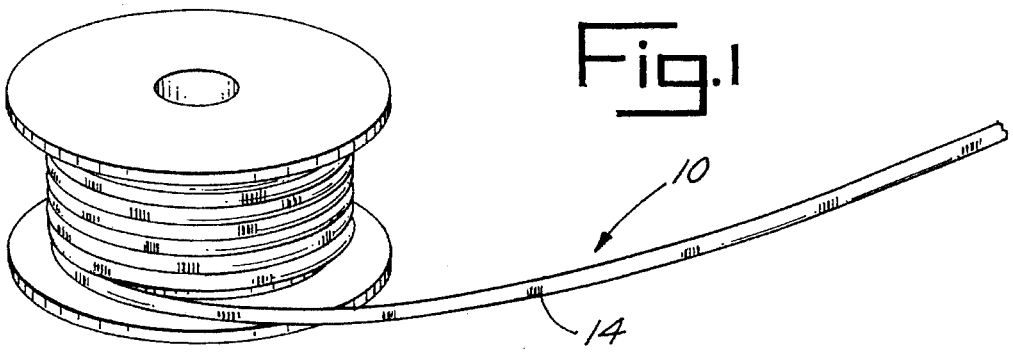
FIG. 1 is a perspective view of one embodiment of the present invention, showing a length of cable on a spool.

FIG. 1 shows medium 10 which may be used to transport or carry information or physical things. As shown in this embodiment, medium 10 may be cable or other similar conduit. Medium 10 is shown wound on a spool. In certain embodiments, medium 10 may be cable which can be used to house wires or smaller cables. Medium 10 may, in fact, house several wires therein. Each such wire may be used to transport information, energy or some other commodity from one location to another. For example, the wire may be a telephone line, an electrical power line, or some other means by which information, energy or some commodity is transported from one location to another.

Medium 10 may also be another type of conduit of transportation, such as pipe or hose. Medium 10 may thus be used to transport fluids or other materials from one location to another.

Medium 10 may be considered a substantially continuous, effectively infinite medium. In other words, at its point of origin or point of manufacture, medium 10 may theoretically be manufactured in a continuous stream, with any portion of the medium being substantially non-distinguishable from any other portion. For example, when medium 10 is cable, the cable may, theoretically, be continuously manufactured, producing a continuous length of cable. Any portion of the cable may be substantially non-distinguishable from any other portion. That is, a portion of cable may not be readily distinguishable from any other portion of cable.

Medium 10 is provided with markings 14 thereon. Markings 14 may be most any form of identification, such as bar code or other types of marking. It may be preferred that markings 14 be machine readable. Each marking 14 on medium 10 is unique and distinct from each other such marking on the entire medium; for example, markings 14 may represent a sequence of integers. Desired information, such as the properties, location, or information contained within medium 10 may be referenced by the marking. For example, an individual marking 14 may be used as a reference to information and identification data of each of the individual wires housed within medium 10.

Markings 14 may be placed on medium 10 in most any manner. Markings 14 may be affixed to the exterior of medium 10, or imprinted therein. It may be possible to mark medium 10 with markings 14 at the time of production of medium 10, at installation of medium 10, or at an intermediate stage.

Figure 4:
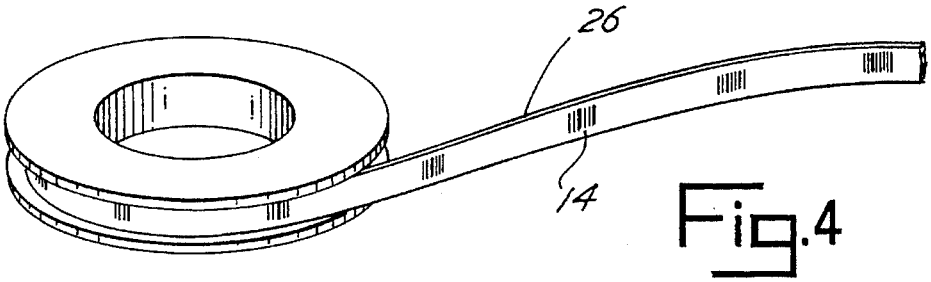
FIG. 4 is a perspective view of another embodiment of the present invention, showing a plurality of markings located on a tape.

Another example of the manner in which markings 14 are placed on medium 10 is through individual stickers (not shown). Each sticker would include a unique marking 14 thereon, and could be placed along medium 10. Another manner in which markings 14 may be placed on medium 10 is through a tape, as shown in FIG. 4. For example, a tape having a series of markings 14 thereon may comprise medium 10. Other methods of applying markings 14 to medium 10 may be used; the manner in which markings 14 are placed on medium 10 does not form a part of the present invention, and should not be inferred as a limitation of the present invention.

Markings 14, as shown, may be spaced at intervals along the length of medium 10. The spacing between successive markings 14 may be varied and may or may not be regular; for exemplary purposes only, markings 14 may be spaced at 6-inch intervals along the length of medium 10.

Figure 2:
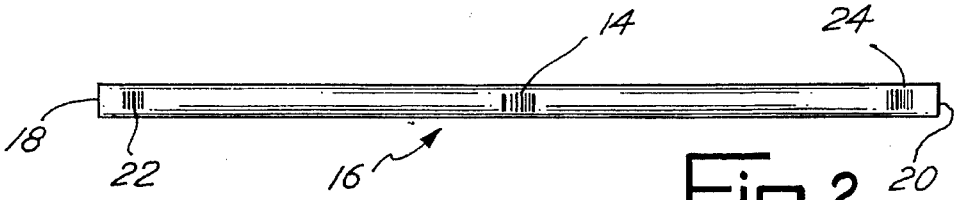
FIG. 2 is a perspective view of a segment of cable.

Once manufactured, medium 10 may be cut into portions of definite length, thus forming segments 16. As shown in FIG. 2, segment 16 has a first end 18 and a second end 20. Marking 14 closest to first end 18 may be referenced as first marking 22, and marking 14 closest to second end 20 may be referenced as second marking 24. In some instances, first marking 22 and second marking 24 may be the same marking, for short segments 16. First marking 22 and second marking 24 define a range of unique markings, physically located between them. In certain embodiments, markings 14 fall sequentially along the length of medium 10, and thus the range of markings 14 is sequential. In other embodiments, markings 14 may not fall sequentially along the length of segment 16. In those embodiments, the range of markings along segment 16 may be defined in some other manner.

In another illustrative embodiment of the present invention, shown in FIG. 4, medium 10 is in the form of a strip of tape 26. Tape 26 includes markings 14 thereon, spaced at intervals along the length of the tape. Tape 26 may be used alone, or in combination with another medium 10.

It should now be readily understood that the objects of the invention are achieved by the present invention. As an exemplary application, medium 10 may be cable, which is to be installed into a building. Medium 10 is marked with markings 14, at production of the medium, at the installation location, or at some intermediate point. The effectively infinite medium 10 is then divided into segments 16. For example, just prior to installation, a segment 16 of cable may be cut from the spool. First marking 22 and second marking 24 of segment 16 are then recorded in a data base. As each marking 14 is unique and distinct, first marking 22 and second marking 24 define a range of unique markings which fall therebetween.

After entering first marking 22 and second marking 24 into the data base, additional information is then entered. Such information may include the date of installation, the function of medium 10, such as a telephone line, computer line, or the like, or other information. This information is entered into the data base to correspond to the entry provided for the range of markings 14.

Figure 3:
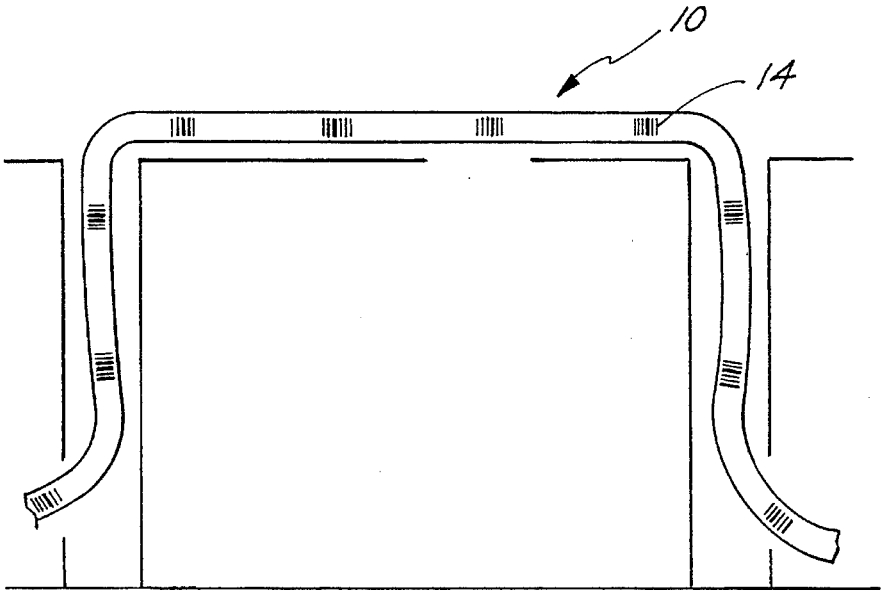
FIG. 3 is a schematic drawing of a segment of cable installed in a building.

Segment 16 of medium 10 may then be installed, such as into a typical office building or other structure. FIG. 3 is a schematic drawing of a segment of cable in a building. Later, when it is desired to access information concerning segment 16, a marking 14 within the range may be identified. The marking may be referenced with the data base, and the desired information may be accessed.

The benefits of such a system may be utilized in several ways. For example, in a typical office building, a segment 16 of medium 10 may extend from one end of the building to a distant end of the building, spanning several individual offices or work stations. Segment 16 may include a plurality of individual wires therein, such as telephone lines, computer lines, electrical power lines, and the like. At certain times, it may be desirable to access certain information concerning the wires in segment 16 at a location intermediate the ends of the segment. The present invention allows one to access segment 16 from any location, such as within a typical office or work space, find a marking 14 on segment 16, and access the information associated with the segment.

FIG. 3 shows a schematic of the present invention in use. Segment 16, having first end 18 and second end 20, is shown installed in an office building. For example, segment 16 may house telephone lines which provide telephone service to the office. When it is desired to access certain information concerning segment 16, a ceiling or wall panel may be removed from the office, exposing segment 16. A marking 14 is located on the segment and is entered into the data base. The corresponding information entered into the data base for the range of markings on segment 16 may then be accessed.

Although the present invention has been described in detail, the same is by way of illustration and example only and is not to be taken by way of limitation. The scope of the present invention is to be limited only by the terms of the appended claims.

What is claimed is:

1. A method for associating information with a segment of a medium, comprising the steps of:

marking the medium with a plurality of unique markings;

defining a length of the medium as a segment, the segment having a first end and second end;

defining a first marking as the marking closest to the first end of the segment and defining a second marking as the marking closest to the second end of the segment;

defining a range of markings starting with the first marking and ending with the second marking;

recording the range together with the information in a data base;

reading any marking from any segment;

locating the entry in the data base whose range includes the reading; and accessing the information associated with the range.

2. The method according to claim 1 wherein the markings are sequential.

3. The method according to claim 2 wherein the medium is cable.

4. The method according to claim 1 wherein the medium is tape.

5. A process for associating information with a segment of a medium, comprising the steps of:

marking the medium with a plurality of unique markings;

defining a length of the medium as a segment, the segment having a first end and second end;

defining a first marking as the marking closest to the first end of the segment and defining a second marking as the marking closest to the second end of the segment;

defining a range of markings starting with the first marking and ending with the second marking; and recording the range together with the information in a data base.

6. The process according to claim 5 further including the step of reading any marking from any segment.

7. The process according to claim 6 further including a step of locating the entry in the data base whose range includes the reading.

8. The process according to claim 7 further including the step of accessing the information associated with the range.

* * * * *